US008700354B1

(12) United States Patent
Bentley et al.

(10) Patent No.: US 8,700,354 B1
(45) Date of Patent: Apr. 15, 2014

(54) WIRELESS MOTION CAPTURE TEST HEAD SYSTEM

(71) Applicant: Blast Motion, Inc., Burlingame, CA (US)

(72) Inventors: Michael Bentley, San Diego, CA (US); Ryan Kaps, San Diego, CA (US); Bhaskar Bose, San Diego, CA (US); Joe Scarbo, San Diego, CA (US)

(73) Assignee: Blast Motion Inc., Burlingame, CA (US)

( * ) Notice: Subject to any disclaimer, the term of this patent is extended or adjusted under 35 U.S.C. 154(b) by 0 days.

(21) Appl. No.: 13/914,534

(22) Filed: Jun. 10, 2013

(51) Int. Cl.

| | |
|---|---|
| ***G01P 15/00*** | (2006.01) |
| ***G01C 9/00*** | (2006.01) |
| ***G01C 17/00*** | (2006.01) |
| ***G01C 19/00*** | (2013.01) |

(52) U.S. Cl.
USPC ..... 702/141; 702/150

(58) Field of Classification Search
USPC ..... 702/141, 150
See application file for complete search history.

(56) References Cited

U.S. PATENT DOCUMENTS

| | | | |
|---|---|---|---|
| 1,712,537 | A | 5/1925 | White |
| 3,182,508 | A | 5/1965 | Varju |
| 3,223,555 | A | 12/1965 | Himy et al. |
| 3,226,704 | A | 12/1965 | Petrash |
| 3,270,564 | A | 9/1966 | Evans |
| 3,606,327 | A | 9/1971 | Na |
| 3,788,647 | A | 1/1974 | Evans |
| 3,792,863 | A | 2/1974 | Evans |
| 3,806,131 | A | 4/1974 | Evans |
| 3,945,646 | A | 3/1976 | Hammond |
| 4,759,219 | A | 7/1988 | Cobb et al. |
| 4,898,389 | A | 2/1990 | Plutt |
| 4,910,677 | A | 3/1990 | Remedio et al. |

(Continued)

FOREIGN PATENT DOCUMENTS

| | | |
|---|---|---|
| CA | 2694123 | 8/2011 |
| KR | 20070120443 | 12/2007 |
| KR | 10-1079319 | 4/2011 |
| WO | 94/27683 | 8/1994 |

OTHER PUBLICATIONS

Armour39 Module & Chest Strap, retrieved from the Internet on Jul. 12, 2013, 6 pages.

(Continued)

*Primary Examiner* — John E Breene
*Assistant Examiner* — Manuel Rivera Vargas
(74) *Attorney, Agent, or Firm* — ARC IP Law, PC; Joseph J. Mayo

(57) ABSTRACT

A wireless motion capture test head system including at least one motion capture element, an isolator, mount and an external computer. The motion capture element(s) may include a memory, a wireless motion capture sensor, a radio and a microcontroller. The microcontroller may collect sensor values data from the wireless motion capture sensor, store the data in the memory, analyze the data, recognize an event within the data to determine event data, and transmit the event data associated with the event via the radio. The isolator may surround the at least one motion capture element to simulate physical acceleration dampening of cerebrospinal fluid around a human brain, in order to minimize translation of linear acceleration and rotational acceleration of the event data to obtain an observed linear acceleration and an observed rotational acceleration of the at least one motion capture element coupled in an inner portion of a headform.

18 Claims, 4 Drawing Sheets

(56) References Cited

U.S. PATENT DOCUMENTS

| | | | |
|---|---|---|---|
| 4,940,236 | A | 7/1990 | Allen |
| 4,991,850 | A | 2/1991 | Wilhlem |
| 5,056,783 | A | 10/1991 | Matcovich et al. |
| 5,086,390 | A | 2/1992 | Matthews |
| 5,111,410 | A | 5/1992 | Nakayama et al. |
| 5,127,044 | A | 6/1992 | Bonito et al. |
| 5,184,295 | A | 2/1993 | Mann |
| 5,230,512 | A | 7/1993 | Tattershall |
| 5,233,544 | A | 8/1993 | Kobayashi |
| 5,249,967 | A | 10/1993 | O'Leary et al. |
| 5,259,620 | A | 11/1993 | Marocco |
| 5,283,733 | A | 2/1994 | Colley |
| 5,298,904 | A | 3/1994 | Olich |
| 5,332,225 | A | 7/1994 | Ura |
| 5,333,061 | A | 7/1994 | Nakashima et al. |
| 5,364,093 | A | 11/1994 | Huston et al. |
| 5,372,365 | A | 12/1994 | McTeigue |
| 5,422,798 | A | 6/1995 | Osiecki et al. |
| 5,441,256 | A | 8/1995 | Hackman |
| 5,441,269 | A | 8/1995 | Henwood |
| 5,486,001 | A | 1/1996 | Baker |
| 5,524,081 | A | 6/1996 | Paul |
| 5,542,676 | A | 8/1996 | Howe et al. |
| 5,592,401 | A | 1/1997 | Kramer |
| 5,626,527 | A | 5/1997 | Eberlein |
| 5,632,484 | A | 5/1997 | Lambert |
| 5,638,300 | A | 6/1997 | Johnson |
| 5,665,006 | A | 9/1997 | Pellegrini |
| 5,688,183 | A | 11/1997 | Sabatino et al. |
| 5,694,340 | A | 12/1997 | Kim |
| 5,772,522 | A | 6/1998 | Nesbit |
| 5,779,555 | A | 7/1998 | Nomura et al. |
| 5,792,001 | A | 8/1998 | Henwood |
| 5,800,279 | A | 9/1998 | Densberger et al. |
| 5,819,206 | A | 10/1998 | Horton |
| 5,826,578 | A | 10/1998 | Curchod |
| 5,868,578 | A | 2/1999 | Baum |
| 5,904,484 | A | 5/1999 | Burns |
| 5,941,779 | A | 8/1999 | Zeiner-Gundersen |
| 5,973,596 | A | 10/1999 | French et al. |
| 6,007,439 | A | 12/1999 | MacKay, Jr. |
| 6,030,109 | A | 2/2000 | Lobsenz |
| 6,044,704 | A | 4/2000 | Sacher |
| 6,073,086 | A | 6/2000 | Marinelli |
| 6,224,493 | B1 | 5/2001 | Lee et al. |
| 6,248,021 | B1 | 6/2001 | Ognjanovic |
| 6,293,802 | B1 | 9/2001 | Ahlgren |
| 6,366,205 | B1 | 4/2002 | Sutphen |
| 6,441,745 | B1 | 8/2002 | Gates |
| 6,443,860 | B1 | 9/2002 | Byrne et al. |
| 6,456,938 | B1 | 9/2002 | Barnard |
| 6,567,536 | B2 | 5/2003 | McNitt |
| 6,582,328 | B2 | 6/2003 | Kuta et al. |
| 6,697,820 | B1 | 2/2004 | Tarlie |
| 6,705,942 | B1 | 3/2004 | Crook et al. |
| 6,709,352 | B1 | 3/2004 | Albin |
| 6,746,336 | B1 | 6/2004 | Brant et al. |
| 6,757,572 | B1 | 6/2004 | Forest |
| 6,774,932 | B1 | 8/2004 | Ewing et al. |
| 6,802,772 | B1 | 10/2004 | Kunzle et al. |
| 6,900,759 | B1 | 5/2005 | Katayama |
| 6,908,404 | B1 | 6/2005 | Gard |
| 6,923,729 | B2 | 8/2005 | McGinty et al. |
| 7,004,848 | B2 | 2/2006 | Konow |
| 7,021,140 | B2 | 4/2006 | Perkins |
| 7,037,198 | B2 | 5/2006 | Hameen-Antilla |
| 7,118,498 | B2 | 10/2006 | Meadows et al. |
| 7,121,962 | B2 | 10/2006 | Reeves |
| 7,143,639 | B2 | 12/2006 | Gobush |
| 7,160,200 | B2 | 1/2007 | Grober |
| 7,175,177 | B2 | 2/2007 | Meifu et al. |
| 7,205,894 | B1 | 4/2007 | Savage |
| 7,219,033 | B2 | 5/2007 | Kolen |
| 7,234,351 | B2 | 6/2007 | Perkins |
| 7,264,098 | B2 | 9/2007 | McPherson |
| 7,264,554 | B2 | 9/2007 | Bentley |
| 7,267,619 | B1 | 9/2007 | Pettis |
| 7,433,805 | B2 | 10/2008 | Vock et al. |
| 7,457,439 | B1 | 11/2008 | Madsen |
| 7,457,724 | B2 | 11/2008 | Vock et al. |
| 7,481,716 | B1 | 1/2009 | Johnson |
| 7,492,367 | B2 | 2/2009 | Mahajan et al. |
| 7,494,236 | B2 | 2/2009 | Lim |
| 7,561,989 | B2 | 7/2009 | Banks |
| 7,623,987 | B2 | 11/2009 | Vock et al. |
| 7,689,378 | B2 | 3/2010 | Kolen |
| 7,713,148 | B2 | 5/2010 | Sweeney |
| 7,736,242 | B2 | 6/2010 | Stites et al. |
| 7,771,263 | B2 | 8/2010 | Telford |
| 7,780,450 | B2 | 8/2010 | Tarry |
| 7,800,480 | B1 | 9/2010 | Joseph et al. |
| 7,813,887 | B2 | 10/2010 | Vock et al. |
| 7,831,212 | B1 | 11/2010 | Balardeta et al. |
| 7,871,333 | B1 | 1/2011 | Davenport |
| 7,966,154 | B2 | 6/2011 | Vock et al. |
| 7,983,876 | B2 | 7/2011 | Vock et al. |
| 8,036,826 | B2 | 10/2011 | MacIntosh et al. |
| 8,117,888 | B2 | 2/2012 | Chan et al. |
| 8,172,722 | B2 | 5/2012 | Molyneux et al. |
| 8,231,506 | B2 | 7/2012 | Molyneux et al. |
| 8,249,831 | B2 | 8/2012 | Vock et al. |
| 8,257,191 | B2 | 9/2012 | Stites et al. |
| 8,348,783 | B2 | 1/2013 | Soracco et al. |
| 8,355,529 | B2 | 1/2013 | Wu et al. |
| 8,425,292 | B2 | 4/2013 | Lui et al. |
| 2001/0029207 | A1 | 10/2001 | Cameron et al. |
| 2001/0035880 | A1 | 11/2001 | Musatov et al. |
| 2001/0045904 | A1 | 11/2001 | Silzer, Jr. |
| 2002/0004723 | A1 | 1/2002 | Meifu et al. |
| 2002/0019677 | A1 | 2/2002 | Lee |
| 2002/0049507 | A1 | 4/2002 | Hameen-Anttila |
| 2002/0052750 | A1 | 5/2002 | Hirooka |
| 2002/0064764 | A1 | 5/2002 | Fishman |
| 2002/0072815 | A1 | 6/2002 | McDonough et al. |
| 2002/0077189 | A1 | 6/2002 | Tuer et al. |
| 2002/0082775 | A1 | 6/2002 | Meadows et al. |
| 2002/0151994 | A1 | 10/2002 | Sisco |
| 2002/0173364 | A1 | 11/2002 | Boscha |
| 2002/0177490 | A1 | 11/2002 | Yong et al. |
| 2002/0188359 | A1 | 12/2002 | Morse |
| 2003/0008722 | A1 | 1/2003 | Konow |
| 2004/0147329 | A1 | 7/2004 | Meadows et al. |
| 2004/0224787 | A1 | 11/2004 | Lindner |
| 2004/0248676 | A1 | 12/2004 | Taylor et al. |
| 2005/0032582 | A1 | 2/2005 | Mahajan et al. |
| 2005/0054457 | A1 | 3/2005 | Eyestone et al. |
| 2005/0215340 | A1 | 9/2005 | Stites et al. |
| 2005/0227775 | A1 | 10/2005 | Cassady et al. |
| 2005/0261073 | A1 | 11/2005 | Farrington, Jr. et al. |
| 2005/0268704 | A1 | 12/2005 | Bissonnette et al. |
| 2005/0272516 | A1 | 12/2005 | Gobush |
| 2005/0282650 | A1 | 12/2005 | Miettinen et al. |
| 2006/0025229 | A1 | 2/2006 | Mahajan et al. |
| 2006/0063600 | A1 | 3/2006 | Grober |
| 2006/0084516 | A1 | 4/2006 | Eyestone et al. |
| 2006/0109116 | A1 | 5/2006 | Keays |
| 2006/0122002 | A1 | 6/2006 | Konow |
| 2006/0199659 | A1 | 9/2006 | Caldwell |
| 2006/0270450 | A1 | 11/2006 | Garratt et al. |
| 2006/0276256 | A1 | 12/2006 | Storek |
| 2007/0081695 | A1 | 4/2007 | Foxlin et al. |
| 2007/0087866 | A1 | 4/2007 | Meadows et al. |
| 2007/0099715 | A1 | 5/2007 | Jones et al. |
| 2007/0111811 | A1 | 5/2007 | Grober |
| 2007/0129178 | A1 | 6/2007 | Reeves |
| 2007/0135225 | A1 | 6/2007 | Nieminen |
| 2007/0135237 | A1 | 6/2007 | Reeves |
| 2007/0270214 | A1 | 11/2007 | Bentley |
| 2007/0298896 | A1 | 12/2007 | Nusbaum |
| 2009/0017944 | A1 | 1/2009 | Savarese et al. |
| 2009/0036237 | A1 | 2/2009 | Nipper et al. |
| 2009/0111602 | A1 | 4/2009 | Savarese et al. |
| 2009/0137333 | A1 | 5/2009 | Lin et al. |
| 2009/0177097 | A1 | 7/2009 | Ma et al. |

(56) References Cited

U.S. PATENT DOCUMENTS

| | | | | |
|---|---|---|---|---|
| 2009/0209358 | A1 | 8/2009 | Niegowski | |
| 2009/0233735 | A1 | 9/2009 | Savarese et al. | |
| 2010/0049468 | A1 | 2/2010 | Papadourakis | |
| 2010/0063778 | A1 | 3/2010 | Schrock et al. | |
| 2010/0063779 | A1 | 3/2010 | Schrock et al. | |
| 2010/0091112 | A1 | 4/2010 | Veeser et al. | |
| 2010/0093458 | A1 | 4/2010 | Davenport et al. | |
| 2010/0113174 | A1 | 5/2010 | Ahern | |
| 2010/0130298 | A1 | 5/2010 | Dugan et al. | |
| 2010/0144414 | A1 | 6/2010 | Edis et al. | |
| 2010/0144456 | A1 | 6/2010 | Ahern | |
| 2010/0216564 | A1 | 8/2010 | Stites et al. | |
| 2010/0222152 | A1 | 9/2010 | Jaekel et al. | |
| 2010/0308105 | A1 | 12/2010 | Savarese et al. | |
| 2011/0015005 | A1 | 1/2011 | Pfeifer | |
| 2011/0037778 | A1 | 2/2011 | Deng et al. | |
| 2011/0053688 | A1 | 3/2011 | Crawford | |
| 2011/0075341 | A1 | 3/2011 | Lau et al. | |
| 2011/0165998 | A1 | 7/2011 | Lau et al. | |
| 2011/0230273 | A1 | 9/2011 | Niegowski et al. | |
| 2011/0230274 | A1 | 9/2011 | Lafortune et al. | |
| 2011/0230985 | A1 | 9/2011 | Niegowski et al. | |
| 2011/0230986 | A1 | 9/2011 | Lafortune | |
| 2012/0115682 | A1 | 5/2012 | Homsi | |
| 2012/0120573 | A1* | 5/2012 | Bentley | 361/679.01 |
| 2013/0060168 | A1* | 3/2013 | Chu et al. | 600/595 |
| 2013/0167290 | A1* | 7/2013 | Ben Ezra | 2/425 |

OTHER PUBLICATIONS

Armour39, Under Armour Guarantee, Getting Started, retrieved from the Internet on Jul. 12, 2013, 7 pages.

Foreman et al. "A Comparative Analysis for the Measurement of Head Accelerations in Ice Hockey Helmets using Non-Accelerometer Based Systems," Nov. 19, 2012, 13 pages.

Gehrig et al, Visual Golf Club Tracking for Enhanced Swing Analysis, Computer Vision Lab, Lausanne, Switzerland, undated.

Grober, An Accelerometer Based Instrumentation of the Golf Club: Comparative Analysis of Golf Swings, 2009.

International Search Report Dated Jul. 18, 2013, 6 pages, PCT Appl. No. PCT/US2013/038694.

International Search Report Dated Mar. 29, 2013, 10 pages.

King, The Design and Application of Wireless Mems Inertial Measurement Units for the Measurement and Analysis of Golf Swings, 2008.

Learn how Swingbyte can improve your game, retrieved on Sep. 6, 2012 from http://www.swingbyte.com, 2 pages.

miCoach Pacer User Manual, 31 pages.

miCoach SPEED_CELL TM, User Manual, 23 pages.

myCaddie, 2009, retrieved on Sep. 26, 2012 from http://www.iMakePars.com, 4 pages.

Nike+iPod, User Guide, 32 pages.

Pocketpro Golf Designs, PocketPro Full Swing Analysis in Your Pocket, www.PocketPro.org.

SureShotGPS SS9000X, Intelligent Touch, Instruction Manual, 25 pages.

Swing it See it Fix it, Improve Gold Swing, SwingSmart Golf Analyzer, retrieved on Sep. 26, 2012 from http://www.SwingSmart.com, 2 pages.

The Nike+FuelBand User's Guide, rev 14, 26 pages.

UP by Jawbone Extended User Guide, 10 pages.

ActiveReply, "TRACE—The Most Advanced Activity Monitor for Action Sports", http://www.kickstarter.com/projects/activereplay/trace-the-most-advanced-activity-monitor-for-actio, 13 pages, Jul. 31, 2013.

* cited by examiner

WIRELESS MOTION CAPTURE TEST HEAD SYSTEM

BACKGROUND OF THE INVENTION

1. Field of the Invention

One or more embodiments setting forth the ideas described throughout this disclosure pertain to the field of mounts as utilized in sporting equipment for electronics and visual markers. More particularly, but not by way of limitation, one or more aspects of the disclosure enable a wireless motion capture test head system.

2. Description of the Related Art

Known systems for mounting electronics on test heads or headforms are generally wired based mounts. These types of systems are utilized test the effectiveness of the sporting equipment or headgear in handling impacts for example. Existing headform acceleration test systems, for example, may cost upwards of $60,000 and are impractical for most users to purchase. Other sensor based systems generally include one or more sensors mounted on a piece of sporting equipment, or coupled to a user, to gather and analyze motion of the sporting equipment or the motion of the user. These types of sensors generally have not been utilized in test environments with headforms for example.

Disadvantages of current systems appear to include the use of wire-based sensors and electronics transmitting sensor data in a wired-manner. Generally, current systems lack any disclosure of a wireless motion capture element coupled to headform of a dummy, that may retrofitted on various types of headgear. In addition, current systems appear to lack the use of an isolator, as part of a wireless motion capture system, that may simulate physical acceleration dampening of cerebrospinal fluid around a human brain, in order to minimize translation of linear acceleration and rotational acceleration of the event data to obtain an observed linear acceleration and an observed rotational acceleration of the at least one motion capture element coupled in an inner portion of a headform, separate from a helmet.

For example, U.S. Pat. No. 4,261,113 to Alderson, entitled "Anthropomorphic dummy for Use in Vehicle Crash Testing", appears to disclose an anthropomorphic dummy used in vehicle crash testing in order to determine the effectiveness of the vehicle safety features. For example, the sensing and detecting devices of Alderson are disclosed as a number of accelerometers secured to the spine of the dummy. The forces and accelerations may be transmitted through a shoulder of the dummy and to the accelerometers, for analysis. However, it appears as though Alderson lacks any disclosure of any wireless sensors coupled to the headform of a dummy to detect one or more of a linear force and a rotational force.

U.S. Pat. No. 7,204,165 to Plaga et al., entitled "Anthromorphic Manikin Head Skull Cap Load Measurement Device", appears to disclose an anthropomorphic dummy head system for measuring forces and moments applied to the back of the head and neck. The dummy head, for example, includes a skullcap that represents the rear portion of a human head that includes a data acquisition system, such as an automotive load cell, with a plurality of wires extending from the data acquisition system to a microprocessor. As such, it appears as though the system of Plaga et al. lacks any disclosure of a wireless motion capture sensor, coupled to a headform, for detecting linear and rotational forces, in a wireless manner, and wireless transmitting the data to a microcontroller. In addition, the system appears to lacks any disclosure of a wireless motion capture element, coupled with a headform, including an isolator such that the motion capture system may simulate physical acceleration dampening of cerebrospinal fluid around a human brain, from the headform.

For example, U.S. Pat. No. 6,826,509 to Crisco et al., entitled "System and Method for Measuring the Linear and Rotational Acceleration of a Body Part", appears to teach away from the current invention, in that the system teaches away from the use of headforms, and rather uses data gathering from a user during game play. The system, for example, uses head acceleration monitoring technology to measure and record linear directions and rotational accelerations during game play, such as using a sporting gear. As such, the system appears to lack any disclosure of a wireless motion capture sensor, coupled to a headform of a dummy, for detecting linear and rotational forces, in a wireless manner, and wireless transmitting the data to a microcontroller, not during game play. In addition, the system appears to lacks any disclosure of an isolator such that the motion capture system may simulate physical acceleration dampening of cerebrospinal fluid around a human brain, from the headform.

United States Patent Publication 20050177929 to Greenwald et al., entitled "Power Management of a System for Measuring The Acceleration of a Body Part", appears to disclose an apparatus and method for determining the linear and rotational acceleration of an impact to a body part, used on a number of protective sports equipment. However, the system of Greenwald et al. discloses, for example, a sensor assembly, such as a proximity sensor, that is head mounted on the protective sports equipment, such as a helmet, and not on a headform of a test dummy. In addition, it appears as though the system of Greenwald et al. uses single-axis accelerometers positioned proximal to the outer surface of a body part, wherein data recorded is stored locally in the helmet, or transmitted to nearby storage. Such a system, however, appears to lack any disclosure of a wireless motion capture element coupled to a headform of a dummy, for example, wherein the wireless motion capture system includes an isolator, such that the motion capture system may simulate physical acceleration dampening of cerebrospinal fluid around a human brain, in order to minimize translation of linear acceleration and rotational acceleration of the event data to obtain an observed linear acceleration and an observed rotational acceleration of the at least one motion capture element coupled in an inner portion of a headform, separate from a helmet.

United States Patent Publication 20120124720 to Circo et al., entitled "Impact Sensing Device and Helmet Incorporating the Same", appears to disclose an impact sensing device, with a plurality of accelerometers, attached to a body location, to produce signals indicative of an impact, during a motion activity. The device of Circo et al. appears to be a device attached to a helmet, for example in the form of a belt, or as a helmet itself, rather than a wireless motion capture sensor, and motion capture element, coupled to a headform of a dummy. In addition, the system appears to lacks any disclosure of a wireless motion capture element, coupled with a headform, including an isolator such that the motion capture system may simulate physical acceleration dampening of cerebrospinal fluid around a human brain, from the headform.

United States Patent Publication 20120210498 to Mack, entitled "Headgear Position and Impact Sensor", appears to disclose protective headgear position and impact sensor, used with hard hats, helmets and other headgear, including proximity sensors used to detect whether the user is wearing the particular headgear. The system appears to disclose a device dummy lacking at least one wireless motion capture sensor, but rather the sensors are located on the headgear. In addition, the system, for example, recognizes data associated with a specific authorized user wearing the headgear, rather than a headform that may be retrofitted onto one or more different types of headgear associated with one or more users. Furthermore, the system of Mack appears to lack an isolator such that a motion capture system may simulate physical acceleration dampening of cerebrospinal fluid around a human brain, from the headform.

United States Patent Publication 20130060168 to Chu et al., entitled "System and Method for Monitoring a Physiological Parameter of Persons Engaged in Physical Activity", appears to disclose a system and method to monitor at least one physiological parameter of a user engaged in a physical activity, such as impact during sports play. The system, for example, discloses a monitoring unit that may generate an alert when the monitored physiological parameter exceeds a threshold, during game play. The system appears to be an in-helmet unit, worn by the player, with a sensor assembly used when the player is engaged in the activity. However, it appears as though the system of Chu et al. lacks any disclosure of a wireless motion capture element, coupled with a headform, including an isolator such that the motion capture system may simulate physical acceleration dampening of cerebrospinal fluid around a human brain, from the headform.

There are no known systems that include electronics on a headform, wherein the electronics are also utilized to provide a visual marker for motion capture. Traditionally, mounts have been used for electronics or visual markers, but not both.

For at least the limitations described above there is a need for a wireless motion capture test head system, including a wireless motion capture element coupled to a headform, and an isolator such that a motion capture system may simulate physical acceleration dampening of cerebrospinal fluid around a human brain, from the headform.

BRIEF SUMMARY OF THE INVENTION

Embodiments of the invention enable a wireless motion capture test head system. One or more embodiments of the invention disclose a wireless motion capture test head system including at least one motion capture element, an isolator and a mount. In at least one embodiment, the at least one motion capture element may include a memory, a wireless motion capture sensor, a radio and a microcontroller that may be coupled with the memory, the wireless motion capture sensor and the radio. The wireless motion capture sensor, for example, may capture any combination of values associated with an orientation, position, velocity and acceleration of the at least one motion capture element. In at least one embodiment, the at least one motion capture sensor may be placed and retrofitted one or more different types of headforms, such that the at least one motion capture element may be "removeably" coupled, and may be easily disconnected, decoupled, connected and disconnected.

The microcontroller, in one or more embodiments, may collect data that includes sensor values from the wireless motion capture sensor, store the data in the memory, analyze the data and recognize an event within the data to determine event data, and transmit the event data associated with the event via the radio. In at least one embodiment, the microcontroller recognizing the event within the data to determine event data may include calculation of a linear acceleration value, or of a rotational acceleration value, or both.

In one or more embodiments of the invention, the wireless motion capture test head system may include an application, or "app", that may execute on a computing device. The computing device, in at least one embodiment, may include a computer and a wireless communication interface, such that the computer may be coupled with the wireless communication interface. According to embodiments of the invention, the computer may execute the application in order to allow the computer to receive the event data from the wireless communication interface, analyze the event data to form motion analysis data and store the event data, or the motion analysis data, or both the event data and the motion analysis data. In one or more embodiment, the computer may execute the application to allow the computer to display information, on a display, with the event data, or the motion analysis data, or both, associated with the at least one headform. For example, in one or more embodiments, the display may be a visual display coupled with the computer or a remote computer, such as a broadcast television, the Internet, etc. In at least one embodiment, the wireless motion capture test head system may include a remote database, such that the computer may transmit the event data to the remote database.

One or more embodiments include the at least one motion capture sensor that maybe coupled within or near the headform, and the microcontroller may calculate a location of impact on the headform. Embodiments of the at least one motion capture sensor may be coupled with a hat or cap, using any type of mount, enclosure or coupling mechanism, as will be discussed below. One or more embodiments of the at least one motion capture sensor may be mounted on a helmet wherein the calculation of the location of impact on the headform is based on the physical geometry of the helmet.

By way of one or more embodiments of the invention, the wireless motion capture test head system includes an isolator that may surround the at least one motion capture element. In at least one embodiment, the isolator may simulate physical acceleration dampening of cerebrospinal fluid around a human brain, in order to minimize translation of linear acceleration and rotational acceleration of the event data to obtain an observed linear acceleration and an observed rotational acceleration of the at least one motion capture element coupled in an inner portion of a headform.

According to at least one embodiment, the wireless motion capture test head system may include one or more external sensors placed on an outside portion of the headform. In one or more embodiments of the invention, the at least one motion capture element may include one or more external sensors that may be placed on one or more headgear. As such, the one or more headgear, in several embodiments, may be tested for one or more of orientation, position, velocity, acceleration, linear acceleration, rotational acceleration and impact force Embodiments of the invention may be configured to calculate a linear acceleration value or a rotational acceleration value or both. This enables rotational events to be monitored for concussions as well as linear accelerations.

Thus, embodiments do not have to translate forces or acceleration values or any other values from the helmet, or other headgear or headform, based acceleration, to the observed brain acceleration values and thus embodiments of the invention utilize less power and storage to provide event specific data, which in turn minimizes the amount of data transfer which yields lower transmission power utilization. Different isolators may be utilized on different headforms, or headgears, based on the type of padding inherent in the headform, or headgear. In one or more embodiments of the invention, the headgear may be one or more of helmets, hats, caps, headbands, and/or other headgear utilized in sports, on pilots, military, etc.

According to at least one embodiment of the invention, the wireless motion capture test head system may include a mount coupled with the isolator. The mount, in one or more embodiments, may also couple the isolator and the at least one motion capture element together, at least within the inner portion of the headform.

By way of one or more embodiments of the invention, the wireless motion capture test head system may include an enclosure, such that the enclosure may house the at least one motion capture element. The enclosure, in at least one embodiment, may comprise a visual marker, such that the visual marker may enable motion capture visually. In one or more embodiments, the enclosure may partially or entirely include one or more of plastic, glass, and/or other materials that allow the wireless signals to entirely pass through the enclosure.

Embodiments of the invention may also include an identifier coupled with the at least one motion capture sensor or the headform. In one or more embodiments, the identifier may include a type or model of headgear, associated with a sport or event, or any other identifier that enables relatively unique identification of a particular event from a particular headgear, headform or motion capture sensor. This enables tests with multiple test dummies or headforms to be identified with respect to the app that is configured to receive data associated with a particular test dummy or headform. One or more embodiments receive the identifier, for example a passive RFID identifier or MAC address or other serial number associated with at least one motion capture sensor, headform and/or headgear, and associate the identifier with the event data and motion analysis data.

In one or more embodiments, the computer may access previously stored event data or motion analysis data associated with the wireless motion capture sensor, other wireless motion capture sensors used, the headform, or other headforms used, the headgear, or other headgears used, for example, to determine the number of, orientation, position, velocity, acceleration, linear acceleration, rotational acceleration and impact force rotations, accelerations, falls or any other motion event. This information may be utilized to calculate failure rates of equipment, e.g., the number of impacts that a particular helmet may sustain or a particular level before failure or damage. Embodiments may also present event data associated with the at least one wireless motion capture sensor based on the event data or motion analysis data associated with the headform, or other piece of equipment associated with the headform, and the previously stored event data or motion analysis data associated with the headform, or other piece of equipment associated with the headform. This enables comparison of motion events, in number or quantitative value, e.g., the maximum rotational acceleration observed in a particular headform, headgear, or historically, or to compare the observed acceleration on a particular headform in comparison between different helmets surrounding the headform.

In one or more embodiments, the enclosure and mount for the at least one motion capture element enables a durable and secure coupling of the motion capture element to the isolator, such as within the inner portion of the headform, or the outer portion. In addition, embodiments enable existing headforms, and headgear, that was not manufactured originally with a mount for electronics to be retrofitted with an enclosure and mount for motion capture element. The apparatus may be located internal or external to the headform, and may show a visual marker for use in visually obtaining motion, including rotation of each marker with offset high contrast dots on each marker for example, in combination with electronically detected motion obtained with the at least one motion capture sensor. For example, the outer portion of the enclosure may display a visual marker on the outer portion while the inner portion of the enclosure may be located on or within the headform. The mount is configured to hold the enclosure to the at least one motion capture element and headform, wherein the enclosure may hold the electronics and/or a visual marker. Embodiments of the invention do not require modifying the headform to include the at least one motion capture element. The at least one motion capture element may be flush mounted with the headform or have any desired length of extension from the outer portion of the headform. The mount also allows for a battery to be easily removed and replaced, for example if a battery is used within the at least one motion capture element or enclosure. Other embodiments may make use of micro harvesting of energy to recharge batteries internal to the enclosure.

One or more embodiments of the mount include a headform enclosure and expander that may be coupled with an attachment element, for example a screw that is aligned along an axis parallel, or perpendicular to the axis of the headform. Any other method or structure that enables a non-permanent mount of the at least one motion capture element, that requires no modification of the headform, is in keeping with the spirit of the invention.

If an electronics package is installed, then generally a positive battery contact, printed circuit board (PCB), an insulator or insulative spacer, with negative electrical contact and battery may be installed between the enclosure and the one or more external sensors. The electronics that may be coupled with the PCB for example may include active motion capture electronics that are battery powered, passive or active shot count components, for example a passive or active radio frequency identification (RFID) tag. Embodiments of the electronics may include motion capture accelerometers and/or gyroscopes and/or an inertial measurement unit along with wireless transmitter/receiver or transceiver components. The RFID tag enables identification of the specific piece of headform shape, size and type, for example to determine which type of headform and/or headgear the motion capture data is associated with. Optionally a wireless antenna may be coupled with the enclosure or alternatively may be implemented integral to the PCB as desired. In one or more embodiments, the antenna may be implemented as a Bluetooth®® antenna embedded in an external portion of the enclosure, for example embedded in epoxy on an outer portion of the enclosure to maximize antenna coverage. One or more embodiments of the invention may also include a Global Positioning System (GPS) antenna. The GPS antenna may be mounted on the printed circuit board or may be located separate from the printed circuit board. One or more embodiments of the invention may also directly or indirectly communicate with any other sensors coupled with the headform and/or headgear. This information may be utilized to display the paths in absolute coordinates on a map for example.

One or more embodiments may include a weight element that is interchangeable with the electronic package in the mount. For example, the weight element may for example weigh close to or the same as the electronics to minimize overall instrumented versus non-instrumented weight differences of the headform, when simulating the shape, size and weight of a user's brain. As such, a weight element, as part of the enclosure, headform, or at least one motion capture element, may be removeably coupled and exchanged. This allows for a headform with multiple motion capture elements to have the same weight with only one or a subset of the total number of motion capture elements so that the headform retains nearly identical weight and center of gravity with zero, one, or N motion capture elements, where N is the maximum number of motion capture elements that the headform is configured to couple with.

By way of one or more embodiments, the visual marker may be mounted on the enclosure for use with visual motion capture cameras. Embodiments of the visual marker may be passive or active, meaning that they may either have a visual portion that is visually trackable or may include a light emitting element such as a light emitting diode (LED) that allows for image tracking in low light conditions respectively. This for example may be implemented with a graphical symbol or colored marker on the enclosure. Motion analysis may be performed externally, for example using a camera and computer system based on the visual marker in any captured images. The visual data may also be utilized in motion analysis in combination with any wireless data from any installed electronics package or electronics associated with the at least one motion capture sensor, and/or associated with the headform.

BRIEF DESCRIPTION OF THE DRAWINGS

The above and other aspects, features and advantages of the ideas conveyed through this disclosure will be more apparent from the following more particular description thereof, presented in conjunction with the following drawings wherein.

DETAILED DESCRIPTION OF THE INVENTION

A wireless motion capture test head system will now be described. In the following exemplary description numerous specific details are set forth in order to provide a more thorough understanding of the ideas described throughout this specification. It will be apparent, however, to an artisan of ordinary skill that embodiments of ideas described herein may be practiced without incorporating all aspects of the specific details described herein. In other instances, specific aspects well known to those of ordinary skill in the art have not been described in detail so as not to obscure the disclosure. Readers should note that although examples of the innovative concepts are set forth throughout this disclosure, the claims, and the full scope of any equivalents, are what define the invention. One skilled in the art will recognize that embodiments of the invention may be utilized in any headgear equipment capable of coupling with the apparatus. This includes any piece of sporting headgear, exercise or medical rehabilitation headgear, for example a baseball helmet, baseball cap, hockey helmet, lacrosse helmet, any other helmet, headband, or any other headgear capable of movement. The apparatus may be located internal or external to the headgear, such as on a headform, and may show a visual marker for use in visually obtaining motion in combination with electronically detected motion obtained with a wireless motion capture sensor. For example, the outer portion of an enclosure may display a visual marker on the outer portion while the inner portion of the enclosure may be located on or within the headform.

Figure 1:
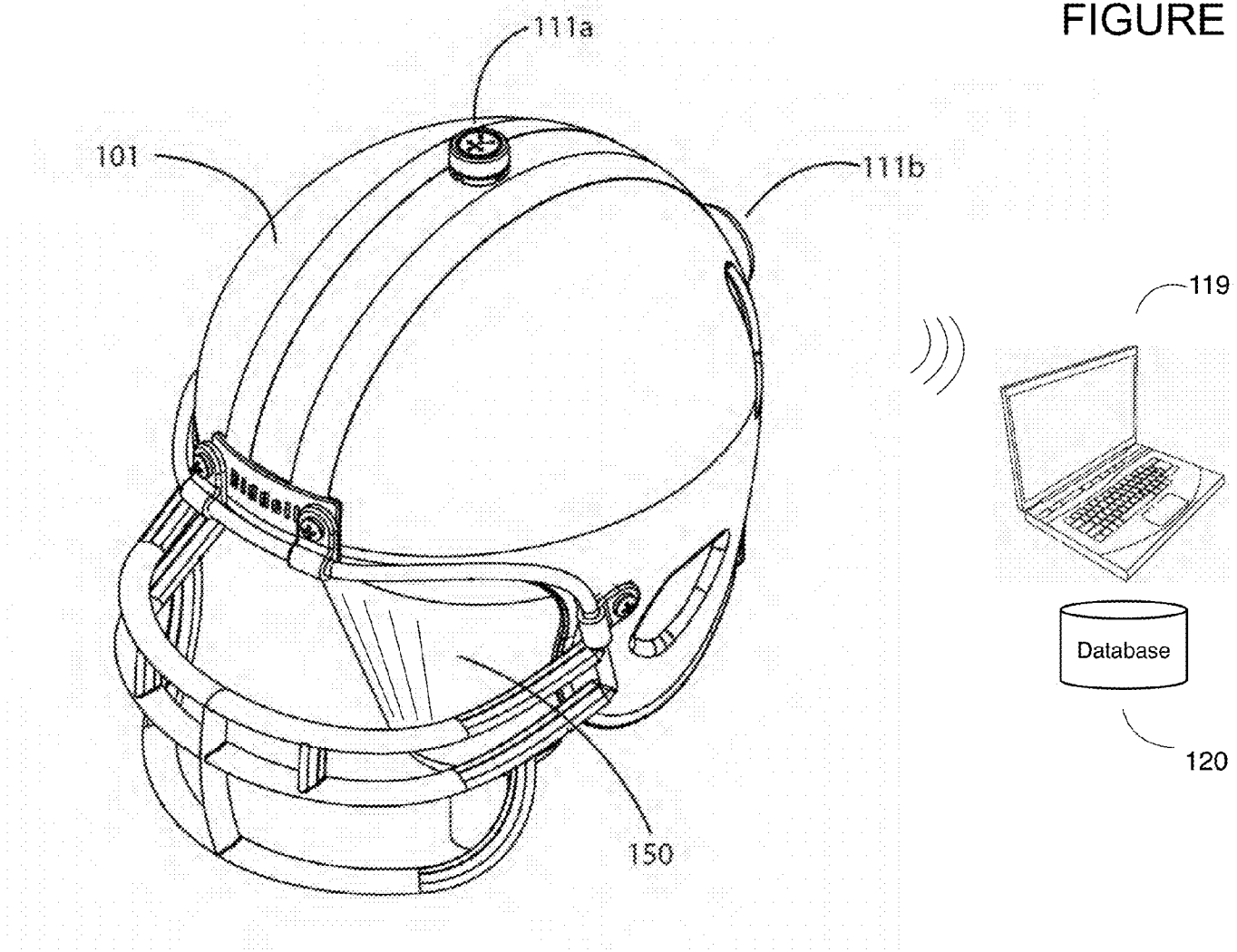
FIG. 1 illustrates the invention in perspective view according to one or more embodiments of the invention.

FIG. 1 illustrates an embodiment of the invention in perspective view. Embodiments enable a mount for a new piece of equipment, such as a headgear 101, that can be retrofitted in an existing headform 150. As shown in FIG. 1, headgear 101 may include one or more external motion capture elements, and/or one or more external sensors, 111*a* and 111*b*. External motion capture elements 111*a* and 111*b* may include an enclosure, a mount, a wireless motion capture sensor, a microcontroller, a radio, and a visual marker located on an outer portion of the enclosure. Also shown in FIG. 1, headgear 101 may be removeably coupled to existing headform 150. The system may be utilized to not only determine how effective the headgear is at reducing shock or impact or acceleration of linear or rotational types, but also to test the motion capture sensors, for example when equipped with motion capture sensors and/or LED or LCD output displays that display information related to the impact, e.g., flash yellow for low impact, or flash red for high impact, or output a message in text or encoded regarding potential medical information. Also shown is remote computer 119 and remote database 120 are configured to wirelessly communicate with one or more motion capture elements coupled to the headform or headgear for example and store events within motion capture data and/or other motion capture data. In one or more embodiments the communication link is bi-directional, wherein commands flow to the motion capture element and acknowledgements and motion capture data flow to the computer.

Figure 2:
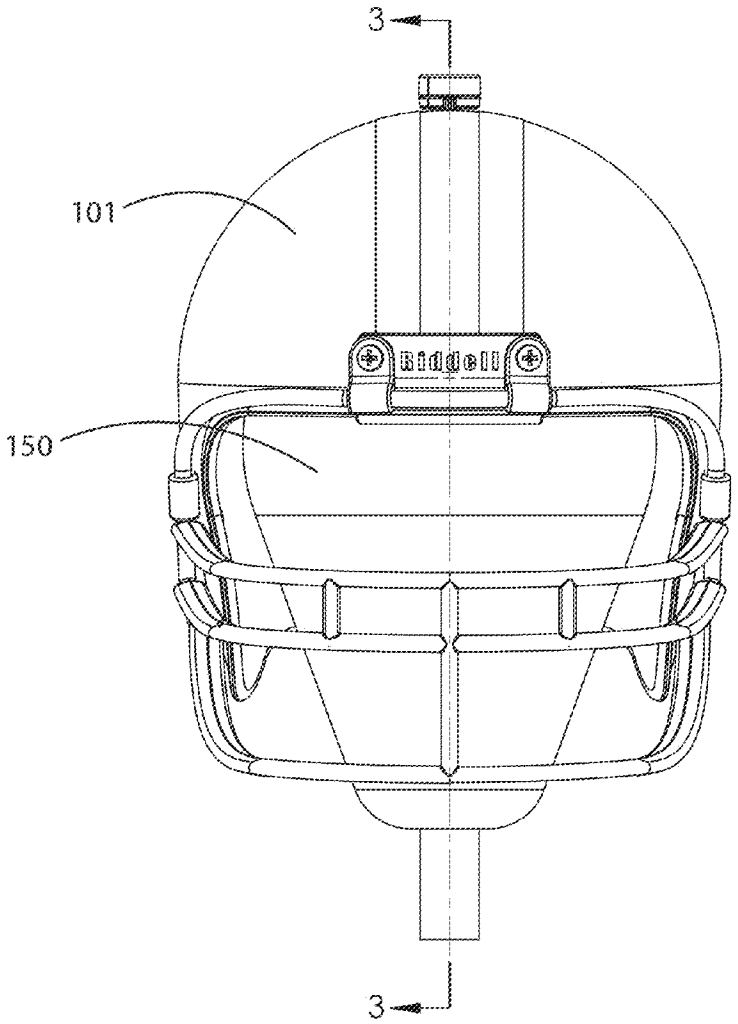
FIG. 2 illustrates a front view of one or more embodiments of the invention.

FIG. 2 illustrates a front view of an embodiment of the invention, with headgear 101 and headform 150. The headform may include any type of headform and the headgear may of any type. In one or more embodiments, a known impact or acceleration is provided to the headform and headgear and the motion capture data from the headform and the headgear are compared to determine the effectiveness of impact absorption of the headgear and impact reduction to the headform.

Figure 3:
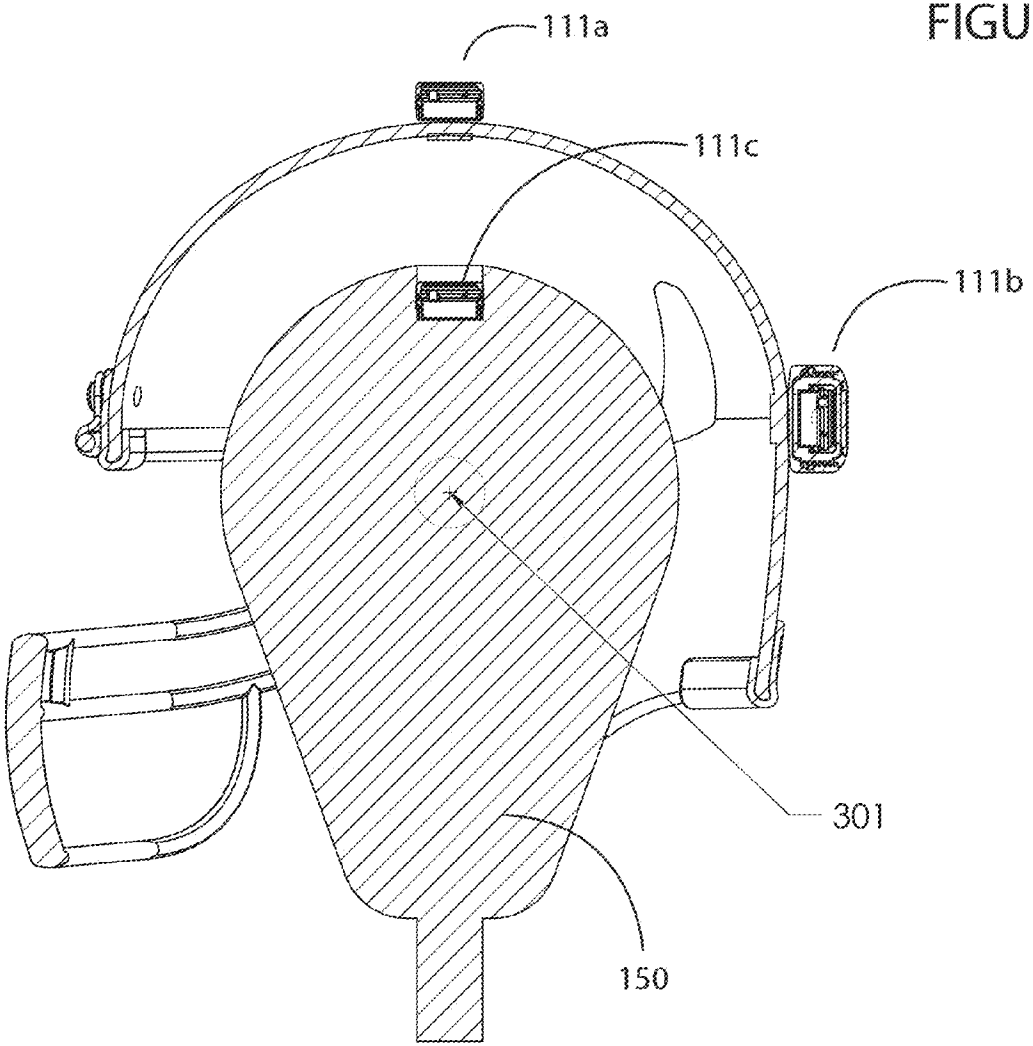
FIG. 3 illustrates a cutaway cross-sectional view of the main components of one or more embodiments of the invention.

FIG. 3 illustrates a cutaway cross-sectional view of the main components of an embodiment of the invention. As shown in FIG. 3, headgear 101 includes one or more external motion capture elements, and/or one or more external sensors 111 and 111*b*. One or more embodiments of the invention disclose a wireless motion capture test head system including at least one motion capture element 111*c*, an isolator and a mount. In at least one embodiment, the at least one motion capture element 111*c* may include a memory, a wireless motion capture sensor, a radio and a microcontroller that may be coupled with the memory, the wireless motion capture sensor and the radio. The wireless motion capture sensor, for example, may capture any combination of values associated with an orientation, position, velocity and acceleration of the at least one motion capture element. In at least one embodiment, the at least one motion capture sensor may be placed and retrofitted one or more different types of headforms 150, such that the at least one motion capture element 111*c* may be "removeably" coupled, and may be easily disconnected, decoupled, connected and reconnected. In one or more embodiments, the motion capture element 111*c* may be located anywhere on the outside or inside of the headform 150, including in any internal compartment for example and so long as the headform allows for the transmission of wireless signals. Although shown with only one motion capture element 111*c* installed or otherwise coupled with headform 150, any number of motion capture elements may be coupled with the headform as desired for the particular application, e.g., for more robust test installations, etc. In addition, as previously mentioned, the motion capture element be opened and an equivalent weight for the electronics/PCB, etc., may be installed to keep the center of gravity identical for the headform even with one or more motion capture elements replaced with equivalent weights.

The microcontroller, in one or more embodiments, may collect data that includes sensor values from the wireless motion capture sensor, store the data in the memory, analyze the data and recognize an event within the data to determine event data, and transmit the event data associated with the event via the radio. In at least one embodiment, the microcontroller recognizing the event within the data to determine event data may include calculation of a linear acceleration value, or of a rotational acceleration value, or both. In one or more embodiments, the sensor may only save a predefined number of samples before a particular level of impact and save a second predefined number of samples after a particular level of impact to provide efficient memory and communication power utilization.

In one or more embodiments of the invention, the wireless motion capture test head system may include an application, or "app", that may execute on a computing device. The computing device, in at least one embodiment, may include a computer and a wireless communication interface, such that the computer may be coupled with the wireless communication interface. According to embodiments of the invention, the computer may execute the application in order to allow the computer to receive the event data from the wireless communication interface, analyze the event data to form motion analysis data and store the event data, or the motion analysis data, or both the event data and the motion analysis data. In one or more embodiment, the computer may execute the application to allow the computer to display information, on a display, with the event data, or the motion analysis data, or both, associated with the at least one headform. For example, in one or more embodiments, the display may be a visual display coupled with the computer or a remote computer, such as a broadcast television, the Internet, etc. In at least one embodiment, the wireless motion capture test head system may include a remote database, such that the computer may transmit the event data to the remote database.

One or more embodiments, as shown in FIG. 3, include the at least one motion capture sensor that maybe worn near the user's head when in actual use (simulated by headform 150), and the microcontroller may calculate a location of impact on the user's head or headform 150. Element 301 represents the approximate center of the user's head, simulated by headform 150. Embodiments of the system may provide a lookup table based on known linear and rotational accelerations that correspond to particular impact locations and/or vectors and save the table in the motion capture element for quick lookup without calculations and associated power utilization on the sensor. Embodiments of the at least one motion capture sensor may be coupled with a hat, cap, helmet, or any other headgear 101, using any type of mount, enclosure or coupling mechanism, as will be discussed below. One or more embodiments of the at least one motion capture sensor may be coupled with a helmet 101 on the user's head, or headform 150, and wherein the calculation of the location of impact on the user's head, or headform 150, is based on the physical geometry of the helmet 101. Embodiments may include a temperature sensor coupled with the at least one motion capture sensor or with the microcontroller for example. This enables the effect of heat on the padding within the helmet to be tested, wherein some padding may be less effective on hot days and may transmit more of the impact on cold days, etc.

By way of one or more embodiments of the invention, the wireless motion capture test head system includes an isolator that may surround the at least one motion capture element. In at least one embodiment, the isolator may simulate physical acceleration dampening of cerebrospinal fluid around a human brain, in order to minimize translation of linear acceleration and rotational acceleration of the event data to obtain an observed linear acceleration and an observed rotational acceleration of the at least one motion capture element coupled in an inner portion of the headform 150. In this manner, more accurate testing is enabled by motion capture element 111*c* when the motion capture element observes the impact that a brain would observe and not what the outside portion of the headform 150 observes, which is different. This type of isolator mounted sensor is unknown in the art.

According to at least one embodiment, the wireless motion capture test head system may include one or more external sensors placed on an outside portion of the headform 150. In one or more embodiments of the invention, the at least one motion capture element 111*c* may include one or more external sensors, 111*a* and/or 111*b*, that may be placed on one or more headgear 101. As such, the one or more headgear 101, in several embodiments, may be tested for one or more of orientation, position, velocity, acceleration, linear acceleration, rotational acceleration and impact force.

Embodiments of the invention may be configured to calculate a linear acceleration value or a rotational acceleration value or both. This enables rotational events to be monitored for concussions as well as linear accelerations.

Thus, embodiments utilizing isolators having tuned dampening effect to match brain fluid dampening do not have to translate forces or acceleration values or any other values from the helmet, or other headgear or headform, based acceleration, to the observed brain acceleration values and thus embodiments of the invention utilize less power and storage to provide event specific data, which in turn minimizes the amount of data transfer which yields lower transmission power utilization. Different isolators may be utilized on different headforms 150, or headgears 101, based on the type of padding inherent in the headform 150, or headgear 101. In one or more embodiments of the invention, the headgear 101 may be one or more of helmets, hats, caps, headbands, and/or other headgear utilized in sports, on pilots, military, or any form of headgear equipment used during motion. The value of dampening of the isolator may be calculated using one exemplary method by mounting a motion capture sensor within a cadaver brain and performing tests with a motion capture element mounted to the cranium and determining the difference in acceleration peaks for given input impact accelerations. Thus, the size and/or hardness of the isolator may be adjusted to accurately simulate the dampening effects of brain fluid.

According to at least one embodiment of the invention, the wireless motion capture test head system may include a mount coupled with the isolator. The mount, in one or more embodiments, may also couple the isolator and the at least one motion capture element 111*c* together, at least within the inner portion of the headform 150.

By way of one or more embodiments of the invention, the wireless motion capture test head system may include an enclosure, such that the enclosure may house the at least one motion capture element 111*c*. The enclosure, in at least one embodiment, may comprise a visual marker, such that the visual marker may enable motion capture visually. In one or more embodiments, the enclosure may partially or entirely include one or more of plastic, glass, and/or other materials that allow the wireless signals to entirely pass through the enclosure.

Embodiments of the invention may also include an identifier coupled with the at least one motion capture sensor or the headform 150. In one or more embodiments, the identifier may include a type or model of headgear 101, and for example later utilized and/or associated with a sport or event, a particular user, such as a student or player identifier, or a group of users, such as a university, military, sports club, etc., or any other identifier that enables relatively unique identification of a particular event from a particular headgear 101, headform 150 or motion capture sensor. This enables tests with multiple test dummies or headforms to be identified with respect to the app that is configured to receive data associated with a particular test dummy or headform. One or more embodiments receive the identifier, for example a passive RFID identifier or MAC address or other serial number associated with at least one motion capture sensor, headform and/or headgear, and associate the identifier with the event data and motion analysis data.

In one or more embodiments, the computer may access previously stored event data or motion analysis data associated with the wireless motion capture sensor, other wireless motion capture sensors used, the headform 150, or other headforms used, the headgear 101, or other headgears used, for example, to determine the number of, orientation, position, velocity, acceleration, linear acceleration, rotational acceleration and impact force rotations, accelerations, falls or any other motion event. This information may be utilized to calculate failure rates of equipment, e.g., the number of impacts that a particular helmet may sustain or a particular level before failure or damage. Embodiments may also present event data associated with the at least one wireless motion capture sensor based on the event data or motion analysis data associated with the headform 150, or other piece of equipment associated with the headform 150, and the previously stored event data or motion analysis data associated with the headform, or other piece of equipment associated with the headform 150. This enables comparison of motion events, in number or quantitative value, e.g., the maximum rotational acceleration observed in a particular headform, headgear, or historically, or to compare the observed acceleration on a particular headform in comparison between different helmets surrounding the headform.

In one or more embodiments, the enclosure and mount for the at least one motion capture element enable a durable and secure coupling of the motion capture element 111*c* to the isolator, such as within the inner portion of the headform 150, or the outer portion. In addition, embodiments enable existing headforms, and headgear, that was not manufactured originally with a mount for electronics to be retrofitted with an enclosure and mount for motion capture element 111*c*. The apparatus may be located internal or external to the headform 150, and may show a visual marker for use in visually obtaining motion in combination with electronically detected motion obtained with the at least one motion capture sensor. For example, the outer portion of the enclosure may display a visual marker on the outer portion while the inner portion of the enclosure may be located on or within the headform. The mount is configured to hold the enclosure to the at least one motion capture element 111*c* and headform 150, wherein the enclosure may hold the electronics and/or a visual marker. Embodiments of the invention do not require modifying the headform 150 to include the at least one motion capture element 111*c*.

In one or more embodiments, the at least one motion capture element 111*c* may be flush mounted with the headform 150 or have any desired length of extension from the outer portion of the headform 150. The mount also allows for a battery to be easily removed and replaced, for example if a battery is used within the at least one motion capture element 111*c* or enclosure. Other embodiments may make use of micro harvesting of energy to recharge batteries internal to the enclosure.

One or more embodiments of the mount include a headform enclosure and expander that may be coupled with an attachment element, for example a screw that is aligned along an axis parallel, or perpendicular to the axis of the headform. Any other method or structure that enables a non-permanent mount of the at least one motion capture element 111*c*, that requires no modification of the headform 150, is in keeping with the spirit of the invention.

Figure 4:
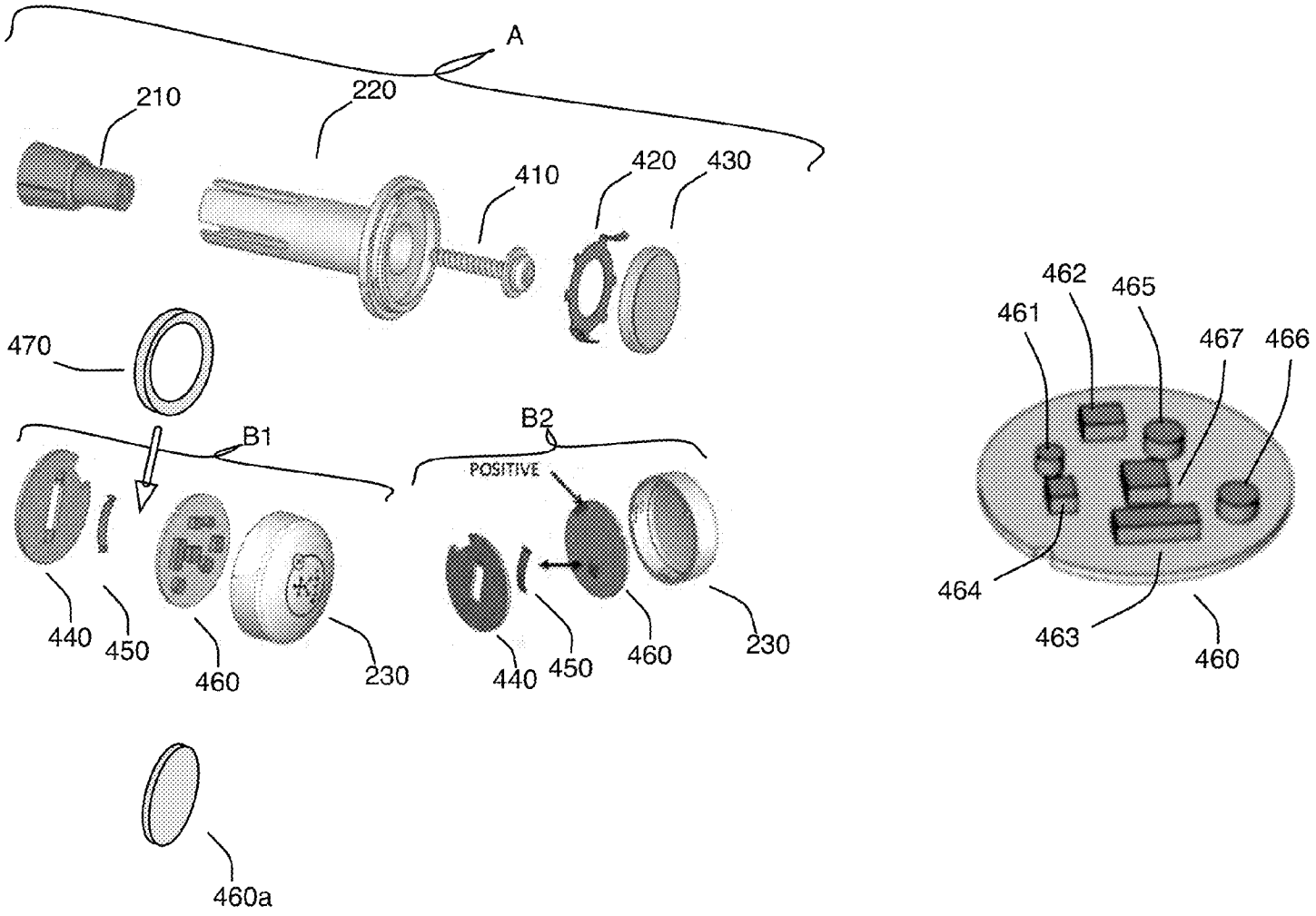
FIG. 4 illustrates an embodiment of the mount and internal components of an exemplary embodiment of the PCB and electronic components.

FIG. 4 illustrates one such embodiment, e.g., an exploded view "A" of one embodiment of a mount configured to hold a motion capture element. As shown, the main mount components, namely expander 210, shaft enclosure 220 along with screw 410, positive battery contact 420 and battery 430, while view "B1" shows a top oriented view of the insulator 440, negative battery contact 450, electronics package 460, here a printed circuit board or PCB and cap 230, while view "B2" shows a bottom oriented view of the same components shown in view "B1". The left portion of shaft enclosure 220 shows extensions or "legs" that allow for the shaft enclosure to radially expand when expander 210 is pulled along the axis shown by screw 410, when screw 410 is rotated. To keep expander 210 from simply rotating when screw 410 is rotated, expander 210 may include a protrusion (shown on the left side of the expander) that aligns in a slot formed by two of the shaft enclosure's legs. In this manner, expander 210 is pulled along the axis of the screw without rotating along that axis. Electronics package 460, shown in detail in the right portion of the figure, for example may include active motion capture electronics that are battery powered, passive or active shot count components, for example a passive or active RFID tag 461, which for example may be coupled with electronics package 460 or for example coupled with insulator 440.

In addition, a GPS module and/or antenna 462 may also be coupled with electronics package 460 or cap 230. Embodiments of the electronics may include motion capture accelerometers and/or gyroscopes and/or an inertial measurement unit 463 along with wireless transmitter/receiver or transceiver components 464. The RFID tag may be coupled with any component shown as RFID tags are tiny, for example cap 230 or shaft enclosure 220 or electronics package 460, or any other element. In addition, a temperature sensor 466 may be included on the PCB or anywhere else on any other component shown to enable remote temperature sensing. Microcontroller, which may include memory 467 for example, may be of any type powerful enough to control the various electronics components coupled thereto and is generally selected from a low power family of microcontrollers for longer battery life. Isolator 470 may be utilized to dampen the impacts that are observed at the inertial measurement unit 463. If utilized, one embodiment of the isolator may be placed around the PCB for example. For motion capture elements that are configured to withstand the full acceleration, the isolator may be removed for example.

According to at least one embodiment of the invention, if an electronics package is installed, then generally a positive battery contact, printed circuit board (PCB), an insulator or insulative spacer, with negative electrical contact and battery may be installed between the enclosure and the one or more external sensors. Any other type of power components may be utilized including motion based charging elements to maximize battery life. Other components such as passive wakeup components and timeout components may be utilized to further extend battery life. The electronics that may be coupled with the PCB for example may include active motion capture electronics that are battery powered, passive or active shot count components, for example a passive or active radio frequency identification (RFID) tag. Embodiments of the electronics may include motion capture accelerometers and/or gyroscopes and/or an inertial measurement unit along with wireless transmitter/receiver or transceiver components. The RFID tag enables identification of the specific piece of headform 150 shape, size and type, for example to determine which type of headform 150 and/or headgear 101 the motion capture data is associated with. Optionally a wireless antenna may be coupled with the enclosure or alternatively may be implemented integral to the PCB as desired. In one or more embodiments, the antenna may be implemented as a Bluetooth® antenna embedded in an external portion of the enclosure, for example embedded in epoxy on an outer portion of the enclosure to maximize antenna coverage. One or more embodiments of the invention may also include a Global Positioning System (GPS) antenna. The GPS antenna may be mounted on the printed circuit board or may be located separate from the printed circuit board. One or more embodiments of the invention may also directly or indirectly communicate with any other sensors coupled with the headform 150 and/or headgear 101.

One or more embodiments may include a weight element 460*a* that is interchangeable with the electronic package in the mount. For example, the weight element may for example weigh close to or the same as the electronics to minimize overall instrumented versus non-instrumented weight differences of the headform 150, when simulating the shape, size and weight of a user's brain. As such, a weight element, as part of the enclosure, headform 150, or the at least one motion capture element 111*c*, may be removeably coupled and exchanged.

Weight element 460*a* can be any shape so long as weight element 460*a* fits within, or couples in any direct or indirect manner with shaft enclosure 220 or 220*a* and cap 230 for example. Weight element 460*a* can be made to weigh as near as desired to the weight of the components that it replaces, for example to enable the test dummy headform to retain exact center of gravity or within any tolerance desired when a particular motion capture element is removed and replaced by weight element 460*a*.

The visual marker may be mounted on cap 230, shown as a circle with dots offset laterally to enable rotational quantitative values to be derived from images, in view B1 may be utilized with visual motion capture cameras. Embodiments of the visual marker may be passive or active, meaning that they may either have a visual portion that is visually trackable or may include a light emitting element such as a light emitting diode (LED) 465 that allows for image tracking in low light conditions respectively. Motion analysis may be performed externally, for example using a camera and computer system based on the visual marker in any captured images. The visual data may also be utilized in motion analysis in combination with any wireless data from electronics package 460.

By way of one or more embodiments, the visual marker may be mounted on the enclosure for use with visual motion capture cameras. Embodiments of the visual marker may be passive or active, meaning that they may either have a visual portion that is visually trackable or may include a light emitting element such as a light emitting diode (LED) that allows for image tracking in low light conditions respectively. This for example may be implemented with a graphical symbol or colored marker on the enclosure. Motion analysis may be performed externally, for example using a camera and computer system based on the visual marker in any captured images. The visual data may also be utilized in motion analysis in combination with any wireless data from any installed electronics package or electronics associated with the at least one motion capture sensor, and/or associated with the headform.

While the ideas herein disclosed has been described by means of specific embodiments and applications thereof, numerous modifications and variations could be made thereto by those skilled in the art without departing from the scope of the invention set forth in the claims.

What is claimed is:

1. A wireless motion capture test head system comprising:
at least one motion capture element comprising
a memory;
a wireless motion capture sensor configured to capture any combination of values associated with an orientation, position, velocity, acceleration of said at least one motion capture element;
a radio;
a microcontroller coupled with said memory, said wireless motion capture sensor and said radio, wherein said microcontroller is configured to
collect data that comprises sensor values from said wireless motion capture sensor;
store said data in said memory;
analyze said data and recognize an event within said data to determine event data;
transmit said event data associated with said event via said radio;
an isolator configured to surround said at least one motion capture element and to simulate physical acceleration dampening of cerebrospinal fluid around a human brain to minimize translation of linear acceleration and rotational acceleration of said event data to obtain an observed linear acceleration and an observed rotational acceleration of said at least one motion capture element coupled in an inner portion of a headform;
a mount coupled with said isolator and configured to couple said isolator and said at least one motion capture element at least within said inner portion of said headform; and,
wherein said at least one motion capture element comprises a printed circuit board and
wherein said isolator surrounds said printed circuit board, such that said isolator is situated between said printed circuit board and said mount.

2. The wireless motion capture test head system of claim 1 further comprising:
a computing device comprising
a computer;
a wireless communication interface;
wherein said computer is coupled with wireless communication interface and wherein said computer is configured to
receive said event data from said wireless communication interface;
analyze said event data to form motion analysis data;
store said event data, or said motion analysis data, or both said event data and said motion analysis data;
display information comprising said event data, or said motion analysis data, or both associated with said at least one headform on a display.

3. The wireless motion capture test head system of claim 2 further comprising:
a remote database;
wherein said computer is further configured to transmit said event data to said remote database.

4. The wireless motion capture test head system of claim 1, wherein said recognize said event within said data comprises calculation of a linear acceleration value, or of a rotational acceleration value, or both.

5. The wire motion capture test head system of claim 1 further comprising an enclosure configured to house said at least one motion capture element.

6. The wireless motion capture test head of claim 1, further comprising an enclosure configured to house said at least one motion capture element wherein said enclosure comprises a visual marker configured with high contrast areas on an outer surface of said motion capture element to enable visual tracking of rotation of said motion capture element.

7. The wireless motion capture test head of claim 1, further comprising one or more external sensors configured to be placed on an outside portion of said headform.

8. The wireless motion capture test head of claim 1, wherein said at least one motion capture element further comprises one or more external sensors configured to be placed on one or more headgear, such that said one or more headgear is tested for one or more of orientation, position, velocity, acceleration, linear acceleration, rotational acceleration and impact force.

9. The wireless motion capture test head system of claim 1, wherein one or more of a size and hardness of said isolator are configured to be adjusted to accurately simulate said physical acceleration dampening of said cerebrospinal fluid.

10. A wireless motion capture test head system comprising:
at least one motion capture element comprising
a memory;
a wireless motion capture sensor configured to capture any combination of values associated with an orientation, position, velocity, acceleration of said at least one motion capture element;
a radio;
a microcontroller coupled with said memory, said wireless motion capture sensor and said radio, wherein said microcontroller is configured to
collect data that comprises sensor values from said wireless motion capture sensor;
store said data in said memory;
analyze said data and recognize an event within said data to determine event data;
transmit said event data associated with said event via said radio;
an isolator configured to surround said at least one motion capture element and to simulate physical acceleration dampening of cerebrospinal fluid around a human brain to minimize translation of linear acceleration and rotational acceleration of said event data to obtain an observed linear acceleration and an observed rotational acceleration of said at least one motion capture element coupled in an inner portion of a headform;
a mount coupled with said isolator and configured to couple said isolator and said at least one motion capture element at least within said inner portion of said headform;
wherein said at least one motion capture element comprises a printed circuit board and
wherein said isolator surrounds said printed circuit board, such that said isolator is situated between said printed circuit board and said mount;
a computing device comprising
a computer;
a wireless communication interface;
wherein said computer is coupled with wireless communication interface and wherein said computer is configured to
receive said event data from said wireless communication interface;
analyze said event data to form motion analysis data;
store said event data, or said motion analysis data, or both said event data and said motion analysis data;
display information comprising said event data, or said motion analysis data, or both associated with said at least one headform on a display.

11. The wireless motion capture test head system of claim 10, further comprising:
a remote database;
wherein said computer is further configured to transmit said event data to said remote database.

12. The wireless motion capture test head system of claim 10, wherein said recognize said event within said data comprises calculation of a linear acceleration value, or of a rotational acceleration value, or both.

13. The wire motion capture test head system of claim 10, further comprising an enclosure configured to house said at least one motion capture element.

14. The wireless motion capture test head of claim 10, further comprising an enclosure configured to house said at least one motion capture element wherein said enclosure comprises a visual marker configured with high contract areas on an outer surface of said motion capture element to enable visual tracking of rotation of said motion capture element.

15. The wireless motion capture test head of claim 10, further comprising one or more external sensors configured to be placed on an outside portion of said headform.

16. The wireless motion capture test head of claim 10, wherein said at least one motion capture element further comprises one or more external sensors configured to be placed on one or more headgear, such that said one or more headgear is tested for one or more of orientation, position, velocity, acceleration, linear acceleration, rotational acceleration and impact force.

17. The wireless motion capture test head system of claim 10, wherein one or more of a size and hardness of said isolator are configured to be adjusted to accurately simulate said physical acceleration dampening of said cerebrospinal fluid.

18. A wireless motion capture test head system comprising:
at least one motion capture element comprising
a memory;
a wireless motion capture sensor configured to capture any combination of values associated with an orientation, position, velocity, acceleration of said at least one motion capture element;
a radio;
a microcontroller coupled with said memory, said wireless motion capture sensor and said radio, wherein said microcontroller is configured to
collect data that comprises sensor values from said wireless motion capture sensor;
store said data in said memory;
analyze said data and recognize an event within said data to determine event data;
transmit said event data associated with said event via said radio;
wherein said recognize said event within said data comprises calculation of a linear acceleration value, or of a rotational acceleration value, or both;

an isolator configured to surround said at least one motion capture element and to simulate physical acceleration dampening of cerebrospinal fluid around a human brain to minimize translation of linear acceleration and rotational acceleration of said event data to obtain an observed linear acceleration and an observed rotational acceleration of said at least one motion capture element coupled in an inner portion of a headform;

a mount coupled with said isolator and configured to couple said isolator and said at least one motion capture element at least within said inner portion of said headform;

wherein said at least one motion capture element comprises a printed circuit board and wherein said isolator surrounds said printed circuit board, such that said isolator is situated between said printed circuit board and said mount, and wherein one or more of a size and hardness of said isolator are configured to be adjusted to accurately simulate said physical acceleration dampening of said cerebrospinal fluid;

a computing device comprising a computer;

a wireless communication interface;

wherein said computer is coupled with wireless communication interface and wherein said computer is configured to receive said event data from said wireless communication interface;

analyze said event data to form motion analysis data;

store said event data, or said motion analysis data, or both said event data and said motion analysis data;

display information comprising said event data, or said motion analysis data, or both associated with said at least one headform on a display;

a remote database;

wherein said computer is further configured to transmit said event data to said remote database;

an enclosure configured to house said at least one motion capture element, wherein said enclosure comprises a visual marker configured with high contrast areas on an outer surface of said motion capture element to enable visual tracking of rotation of said motion capture element; and wherein said at least one motion capture element further comprises one or more external sensors configured to be placed on one or more headgear, such that said one or more headgear is tested for one or more of orientation, position, velocity, acceleration, linear acceleration, rotational acceleration and impact force.

* * * * *